United States Patent [19]

Clugston

[11] 4,145,842

[45] Mar. 27, 1979

[54] AUTOMATIC UNLATCHING AND RELATCHING DRIVE-THROUGH GATE APPARATUS

[76] Inventor: George D. Clugston, R.R. #3, Box 203, Pittsburg, Kans. 66762

[21] Appl. No.: 850,664

[22] Filed: Nov. 11, 1977

[51] Int. Cl.[2] ..... E05C 15/00

[52] U.S. Cl. ..... 49/364; 49/236

[58] Field of Search ..... 49/236, 364, 366, 131, 49/279, 272, 262, 263

[56] References Cited

U.S. PATENT DOCUMENTS

| | | | |
|---|---|---|---|
| 1,663,152 | 3/1928 | Baeth | 49/364 X |
| 2,585,481 | 2/1952 | Martin | 49/364 |
| 2,742,722 | 4/1956 | Schaefer | 49/364 X |
| 2,810,220 | 10/1957 | Koch | 49/364 |
| 3,199,237 | 8/1965 | Koch | 49/364 |

*Primary Examiner*—Philip C. Kannan

*Attorney, Agent, or Firm*—Schmidt, Johnson, Hovey & Williams

[57] ABSTRACT

A pair of swingable gate sections include respectively associated latching mechanisms for normally latching the gate sections in a closed position and further include a pair of spaced triggering members engageable by an approaching vehicle for automatically activating the latching mechanisms to unlatch the gate sections and allow the latter to be swung to an open position under the force exerted by the vehicle as the latter passes through the gated area. The gate sections are respectively mounted by inclined hinges on a pair of spaced supporting members whereby the gate sections are automatically drawn under the influence of gravity back to their closed positions after the vehicle has passed therethrough whereupon the latching mechanisms automatically relatch the gate sections in their closed positions. The engageable trigger members each comprise a pivotally mounted U-shaped structure presenting an engageable surface area on each side of each gate sections to allow a vehicle to automatically unlatch the gate sections by traversing the gated area in either of two directions. Each gate section is provided with a pair of actuatable latching members which cooperatively engage corresponding keeper elements stationarily secured on the ground to latch the gate sections in a closed position, and the latching mechanisms are responsive to the pivotal movement of the trigger members for releasing selective ones of the latching members from their corresponding keeper elements to accomplish unlatching of the gate sections. As a further feature, a locking assembly connected between adjacent extremities of the gate sections functions to maintain the latter in a closed position until both of the trigger members are simultaneously actuated by a vehicle whereby to simultaneously unlatch each of the gate sections for swinging movement to the open positions thereof, thus preventing inadvertent opening of a single gate section by livestock having engaged a single triggering member.

8 Claims, 7 Drawing Figures

Fig. 1.
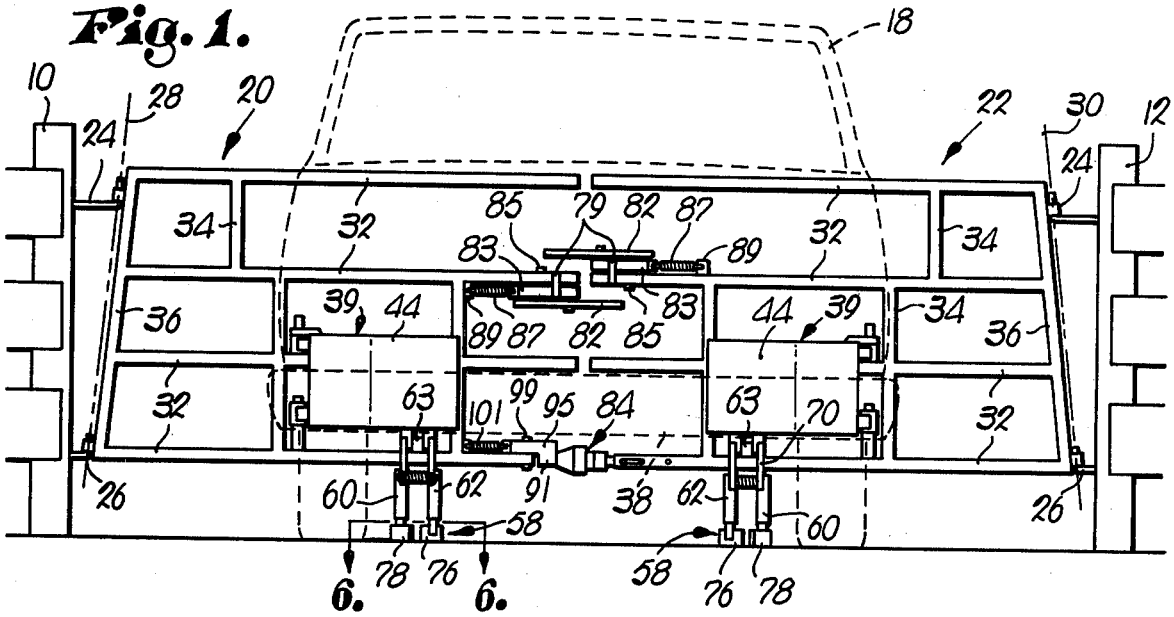
Fig. 2.
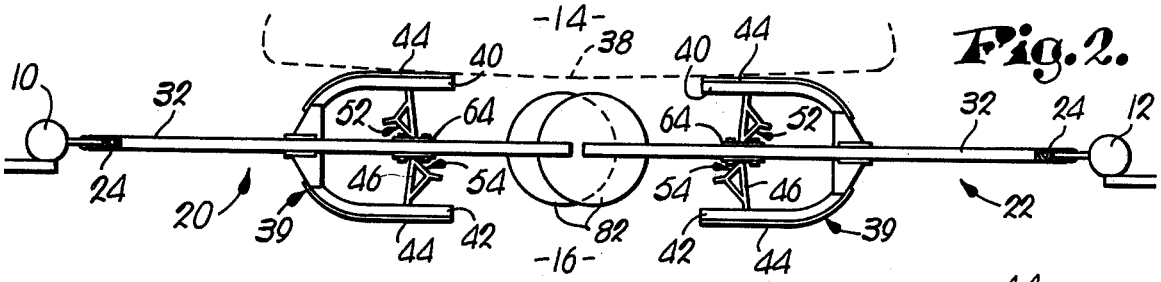
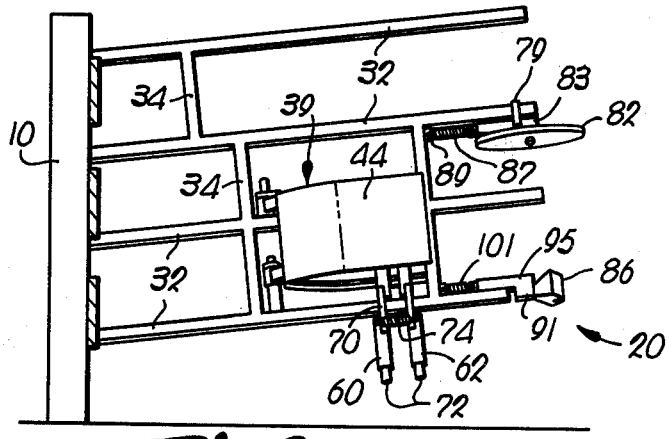
Fig. 3.
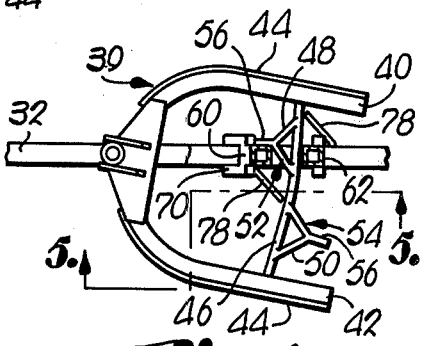
Fig. 4.
Fig. 5.
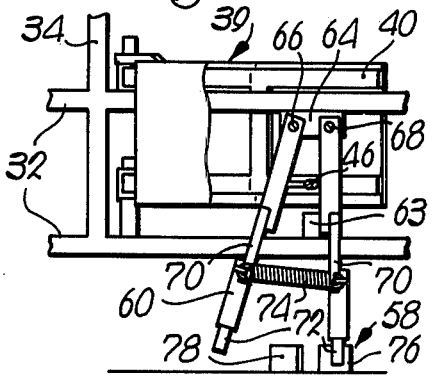
Fig. 7.
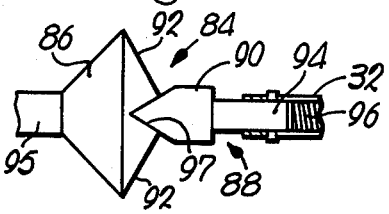
Fig. 6.
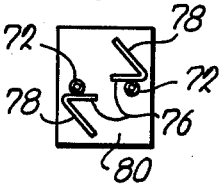

AUTOMATIC UNLATCHING AND RELATCHING DRIVE-THROUGH GATE APPARATUS

BACKGROUND AND BRIEF DESCRIPTION OF THE INVENTION

This invention generally deals with gate structures and pertains more particularly to gating apparatus which is automatically unlatched and opened by a vehicle approaching the gate area and is automatically closed and relatched after the vehicle has passed therethrough.

Gating structures such as those commonly used in conjunction with fences in rural farm areas must often be maintained in a closed, latched position to prevent escape of livestock from fenced-in areas. Most of these type of gate structures are of sufficient width to accommodate agricultural implements and other vehicles, consequently, persons passing through such gated areas are often carried by a vehicle. When driving through such a gate, the individual must usually park and leave his vehicle in order to unlatch and open the gate to allow the vehicle to pass therethrough, and the vechicle must again be parked after traversing the gate to allow manual closure and relatching of the gate; this problem is compounded and is particularly time consuming in rural areas where several gates must be traversed in reaching a destination.

Others in the past have suggested the employment of actuatable mechanisms which might be engaged by an approaching vehicle to unlatch a gate, but these previous approaches have been unsatisfactory for one or more reasons. A primary reason for lack of success of prior art automatic gate apparatus is that previous actuating mechanisms which could be engaged by a vehicle such as a truck could likewise be engaged and actuated by livestock; thus, prior art automatic gate apparatus was subject to inadvertent actuation and was therefore unreliable.

The present invention overcomes the deficiencies inherent in the previous automatic gate apparatus designs and provides gate apparatus having novel mechanism which not only assures positive automatic gate latching and unlatching but also prevents inadvertent gate opening and is therefore particularly reliable. Accordng to the present invention, a pair of swingably mounted gate sections each include a trigger portion engageable by a vehicle approaching the gate area from either side thereof, and further include mechanism for selectively releasing one of a pair of latching members mounted on each gate section from a latching bracket stationarily mounted on the ground thereby unlatching the corresponding gate section for swinging movement in the direction away from the approaching vehicle. Inclinded hinged mounting of the gate sections allow gravity to urge the gate sections to return to their normally closed positions after the vehicle has traversed the gated area. A locking assembly connecting the adjacent extremities between the gate sections functions to interlock the latter and prevents a single gate section from opening so that the engageable trigger portion of each gate section must be simultaneously engaged whereby to simultaneously actuate the associated latching mechanisms to a released condition and allow the gate sections to swing open at the same time.

A primary object of the present invention is to provide a drive-through gate apparatus for automatically gating a zone extending across a passageway, which is automatically unlatchable and openable in response to the approach of a vehicle toward the zone and is automatically closeable and relatchable after the vehicle has trasversed the zone.

Another object of the invention is to provide gate apparatus including a pair of side-by-side, swingable gate sections which are normally latched in a closed position but which are automatically unlatched upon engagement therewith by a vehicle travelling therethrough and are swung to an open position under force exerted by the vehicle.

A further object of the present invention is to provide gate apparatus of the mentioned type wherein a pair of spaced apart vehicle engageable trigger portions respectively associated with each of the gate sections must be simultaneously actuated in order to effect opening of either of the gate sections.

A still further object of the present invention is to provide gate apparatus of the type described which includes mechanism for interlocking the gate sections whereby to prevent the opening of one of such sections when only a single gate section has been unlatched thereby preventing inadvertent opening of either of the gate sections.

Another object of the present invention is to provide a pair of gate sections of the mentioned type which are mounted for swinging movement in a plane inclined from horizontal whereby to employ the influence of gravity to cause the gate sections to return to their normally closed positions thereof after a vehicle has passed therethrough.

Other and further objects of the invention will be made clear or will become apparent in the course of the following description of a preferred embodiment of the invention.

DETAILED DESCRIPTION OF THE INVENTION

In the accompanying drawing:

FIG. 1 is a side elevational view of drive-through gate apparatus which forms the preferred embodiment of the present invention, shown in its closed, latched position just prior to engagement therewith by a vehicle indicated in the phantom;

FIG. 2 is top plan view of the gate apparatus, stationary ground mounted latching means having been ommitted in order to more clearly reveal shiftable portions of engageable means for unlatching the gate apparatus, a vehicle bumper shown in phantom having initially engaged the gate apparatus;

FIG. 3 is an end elevational view showing one of the gate sections swung to its open position;

FIG. 4 is a fragmentary, top cross-sectional view of structure for unlatching one of the gate sections;

FIG. 5 is a view taken along the line 5—5 in FIG. 4;

FIG. 6 is a view taken along the line 6—6 in FIG. 1; and

FIG. 7 is a fragmentary, top cross-sectional view of mechanism for locking adjacent portions of the gate sections to each other.

Referring now to the drawing, a drive-through gate apparatus gates a transversely extending zone between the spaced, upright support members 10 and 12 across a longitudinally extending passageway such as a road or path having stretches 14 and 16 on opposite sides of the zone. The gate apparatus is adapted to be automatically unlatched and opened by a vehicle 18 travelling along the passageway and approaching the gated zone from either stretch 14 or 16.

The gate apparatus includes a pair of gate sections generally designated by the numerals 20 and 22, which are normally disposed end-to-end across the gated zone. The gate sections 20 and 22 have the outer extremities thereof respectively pivotally mounted on the support members 10 and 12 by means of elevationally spaced hinge sections including upper hinge 24 and lower hinge 26. The hinges 24 and 26 associated with each gate section 20 and 22 each include a single pivotal axis aligned with the respective reference axes shown by the broken lines 28 and 30 which are inclined away from vertical and toward each other. Thus, it is apparent that gate sections 20 and 22 are respectively swingable about the inclined reference axes 28 and 30 whereby to swing in a plane which is slightly inclined from horizontal.

Gate sections 20 and 22, which may be constructed from any suitable structural stock, each comprise a plurality of vertically spaced, generally horizontally extending structural members 32 joined together by vertical connecting struts 34 and an upwardly extending end member 36 to form a rigid structural unit, however, it is to be noted that the adjacent extremities of members 32 associated with gate sections 20 and 22 are essentially free from any vertically connecting structure.

Each of the gate sections 20 and 22 include engageable triggering portions which may be contacted by parts of the vehicle 18 such as the bumper 38 thereof for unlatching the gate sections 20 and 22; these engageable portions include a generally U-shaped structure 39 having a bight mounted on members 32 for pivotal movement about an upright axis, and a pair of legs 40 and 42 respectively disposed on opposite sides of gate sections 20 and 22 adjacent stretches 14 and 16. Each of the legs 40 and 42 present essentially vertical, engageable surface areas 44 to the on-coming vehicle 18, which surface areas 44 are essentially equally spaced from the main structural members of the gate sections 20 and 22 and are equally elevationally spaced from the ground so as to be essentially simultaneously engageable by the vehicle 18.

As shown in FIGS. 2 and 4, shiftable means comprising a slightly arcuate, longitudinally extending rib 46 has the opposite ends thereof suitably secured to the interior facing sides of legs 40 and 42 and is shiftable through the structural members of the gate sections 20 and 22 when the U-shaped structure 39 pivots as a result of engagement therewith by the vehicle 18. A pair of longitudinally spaced apart, triangularly shaped cam elements 48 and 50 having oppositely facing cam faces 52 and 54, are respectively secured on opposite sides of the rib 46 and each include an outwardly depending stop ear 56 at the apex thereof whose function will become later apparent. Latching means associated with each of the gate sections 20 and 22 include a shiftable latchable portion mounted on the respective gate sections which is engageable by the above discussed shiftable means, and further includes a later described stationary latching portion generally indicated by the numeral 58. The latchable portion of the latching means includes a pair of elongate, normally vertically extending latch members 60 and 62 having the upper extremities thereof respectively mounted on plate 64 which depends from member 32, to allow outward swinging movement of the free lower extremities thereof about respective laterally spaced axes 66 and 68. As best seen in FIGS. 4 and 5, intermediate stretches of each of the latch members 60 and 62 include a pair of spaced apart leg portions 70 defining an opening therebetween for receiving one of the structural members 32 therethrough to confine swinging movement of the latch members to a direction aligned with the members 32 for reasons which will become later apparent. The lower extremities of the latch members 60 and 62 include a contact portion 72 of generally circular cross section for engaging structure associated with the stationary latching portion 58. An ordinary helical spring 74 has the opposite ends thereof connected between intermediate stretches of the latch members 60 and 62, and functions to bias the lower extremities of each of the latter toward each other. A stop block 63 secured to the member 32 between the latch members 60 and 62 engages each of the latter and functions to maintain the spacing of the lower extremities of the members 60 and 62. The stationary latching portion 58 of the latching means includes a split, Z-shaped upstanding bracket structure comprising a pair of longitudinally spaced apart, stop elements 76 having adjacent, oppositely facing surface portions adapted to engage the contact portion 72 of the latch members 60 and 62. A pair of camming plates 78 respectively associated with the stop elements 76 each have one end thereof connected to one extremity of a corresponding stop element 76 and extends horizontally away from the latter toward the respectively adjacent stretch of the passageway and at an angle with respect to the latter. The Z-shaped bracket structure is suitably secured beneath the corresponding gate section 20 or 22 by any suitable means, and in the form disclosed herein may be mounted as by welding on the plate 80 which in turn may be securely fastened to the ground.

A wheel member 82 made from rubber or the like is mounted on each of the adjacent extremities of each of the gate sections 20 and 22 and more particularly on adjacent extremities of the horizontally aligned shiftable levers 83 for rotation about an essentially upright axes, the diameter of wheel members 82 being selected such that the periphery of each of the wheel members 82 comprises the outer most extremity of its associated gate section, and generally overlaps adjacent portions of the opposing gate section. Shiftable levers 83 extend essentially parallel to the corresponding structural members 32 and have central portions thereof mounted by pivot pins 85 to the corresponding members 32 for horizontal pivoting with respect to the latter, while the distal extremities of the levers 83 are connected to one end of helical springs 87, the opposite ends of springs 87 being secured to the lugs 89 depending from structural portions of the gate sections 20 and 22. Thus, it can be appreciated that the wheel members 82 are horizontally pivotable with respect to the gate sections 20 and 22, there being further provided vertically extending stop tabs 79 depending from the structural members 32 on opposite sides of each of the latter for engaging the levers 83 and limiting the pivotal movement of the wheel members 82.

A locking assembly generally indicated by the numeral 84 includes female structure 86 associated with gate section 20 secured to a mounting member 91 adjacent gate section 22, while a male portion 88 is mounted on a structural member 32 of the extremity of gate section 22 adjacent gate section 20. Mounting member 91 includes a swingable arm 95 pivotally mounted by pivot pins 99 to the associated structural member 32 for swinging movement about an upright axis, the outer ends of arm 95 being connected via helical spring 101 to structural portions of the gate section 20. Female structure 86 includes a V-shaped, recessed area 97 therewithin adjacent the extremity of gate section 22 for complementally receiving a generally V-shaped male element 90 therewithin, thereby providing an interlock between the adjacent extremities of gate sections 20 and 22. Female structure 86 includes a pair of generally vertical, angular faces 92 on opposite sides of the recessed area 97 whose purpose will become apparent later. The male element 90 is connected by means of a shaft 94 slidably recieved within the interior of member 32 associated therewith, there being further provided a spring device 96 secured within the latter mentioned member 32 for engaging the shaft 94 whereby to yieldably urge the male element 90 into contact with the female structure 86.

In use, the gate sections 20 and 22 are normally in a closed position with the latching means in combination with the locking assembly 84 maintaining the same in the closed position. Assuming now that the gate apparatus is in its closed position, a vehicle 18 approaching the gate apparatus from one side of the passage adjacent the stretch 14 thereof, will eventually simultaneously engage the surface areas 44 of the U-shaped structure 39 whereupon the legs 40 of each of the latter will pivot inwardly toward the gate sections 20 and 22 thereby causing the shiftable means including the ribs 46 to travel away from the vehicle and shift through the corresponding structural portions of the gate sections 20 and 22. As the ribs 46 travel away from the vehicle 18, and more particularly between the latch members 60 and 62, the cam face 52 of the cam element 48 eventually slidably engages a portion of the latch member 60 eventually imparting movement to the latter and causing the contact portion 72 thereof to swing laterally outwardly out of engagement with the corresponding stop element 76, thereby simultaneously unlatching each of the gate sections 20 and 22. Upon continued pivotal movement of the structures 39, the stop ears 56 eventually engage intermediate stretches of the latch members 60 to limit the pivotal movement of the structures 39 and transfer the force being imposed by the vehicle 18 on the legs 40 to the latch members 60. With the members 60 held in their unlatched position, the leg portions 70 are urged into contact with the structural members 32 disposed therebetween, thereby transmitting the force imposed by stop ears 56 to the structural portions of the gate sections 20 and 22. At this point, with both the gate sections 20 and 22 having been unlatched by initial engagement of the wheels 18 with the engageable structures 39, further movement of the vehicle 18 through the gated zone causes the gate sections 20 and 22 to swing about their respective axes 28 and 30 toward the stretch 16 while the surface areas 44 slidably engage the bumper 38 of the vehicle 18 until eventually the periphery of wheel members 82 engage first the front and then the sides of the vehicle 18 as the latter traverses the gated zone. Also, upon initial swinging motion of the gate sections 20 and 22, the male element 90 is automatically withdrawn from the recessed area 97 of female structure 86 due to the opposite lateral directions of movement of the adjacent extremities of gate sections 20 and 22, thereby unlocking the locking assembly 84. Upon contact of the vehicle 18 with the wheel members 82, the latter rotate and function to maintain the normally adjacent extremities of the gate sections 20 and 22 in spaced relationship to the sides of vehicle 18 whereby to prevent scratching or marring of the latter. As the vehicle 18 proceeds through the gated zone, the gate sections 20 and 22 each swing slightly upwardly in their plane of inclined swinging motion and come to rest in open position with the outer extremities thereof elevated somewhat above their normal elevation when the gate sections 20 and 22 are in their normally closed positions. After the vehicle 18 has traversed the gated zone, the gate sections 20 and 22 return under the influence of gravity to their normally closed positions. As the gate sections 20 and 22 return to the closed positions thereof, the springs 74 urge the latch members 60 to swing back to the latter's normally vertical positions thereby transferring the force of the springs 74 to the cam elements 48 and 50 through the respective faces 52 and 54 of the latter, causing the engageable structures to shift back to their neutral, non-engaged positions. Just prior to the return of the gate sections 20 and 22 to their closed positions, the contact portions 72 associated with latch members 60 come into sliding contact with their respectively associated camming plates 78 and are shifted outwardly by the latter as the gate sections 20 and 22 continue to close, so that the contact portions 72 are drawn around the outer extremity of stop elements 76 whereupon the springs 74 urge the contact portions 72 to resume their latched positions in engagement with the stop elements 76. From the preceding description it can be appreciated that novel structure and mechanism is also provided for automatically effecting latching and unlatching of the gate apparatus when a vehicle approaches the gated zone from stretch 16 of the passageway; as a vehicle 18 approaches the gate sections 20 and 22 from the stretch 16, the bumper 38 of the vehicle 18 engages the surface areas 44 of legs 42 associated with the engageable structures 39, whereupon the latter pivot causing cam faces 54 to engage the latch members 62 urging the latter to swing outwardly out of engagement with the corresponding stop element 76 thereby unlatching the gate sections 20 and 22 so that the latter may swing outwardly toward the stretch 14. Similarly, as the gate sections 20 and 22 swing back to their normally closed positions, after the vehicle 18 has passed therethrough, the contact portions 72 of latch members 62 engage the respectively associated camming plates 78 which function to guide the contact portions 72 to their home, latched positions in contact with stop elements 76.

As a further feature of the invention, the spring biased, pivotal mounting of the wheel members 82 and female structure 86 provides an effective arrangement for assuring that the gate sections 20 and 22 are automatically unlatched and opened in the normal manner even when a vehicle 18 approaches the gated zone at an angle thereto rather than squarely "head-on", such that portions of the vehicle 18 engage the wheel member 82 of one of the gate sections 20 and 22 and impose a gate opening forces on the latter prior to engagement of the associated engageable structure 39 and unlatching of such gate section; under these circumstances, in the absence of the arrangement mentioned above, the first contacted gate section would remain latched and therefore would not yield to the force imposed thereon by the vehicle, in which case such gate section could be damaged or otherwise rendered inoperative. This feature of the invention can best be appreciated by way of the following example. Assume that a vehicle 18 is approaching the gate sections 20 and 22 at an angle with respect to the latter such that portions of the vehicle 18 contact the wheel member 82 of the gate section 22 prior to contacting the engageable structure 39 associated with that gate section; under these conditions, the force transmitted by the vehicle 18 through the wheel member 82 to the lever 83 overcomes the influence of spring 87 thereby allowing the wheel member 82 to yield to the vehicle 18 and swing slightly away from the latter until the vehicle's bumper 38 engages the engageable structure 39 of gate section 22 whereby to unlatch the latter. Moreover, in the above described example, in the event that the vehicle 18 first engages and unlatches the gate section 20 prior to unlatching of the gate section 22, the gate section 20 is allowed to swing away from the vehicle while the gate section 22 remains stationary, due to the fact that arm 95 swings about pivot pin 99 as the gate section 20 swings open to allow the female structure to be drawn away from the male portion 88. Similarly, in the event that gate section 22 is unlatched prior to unlatching of section 20, the swingable arm 95 allows the male portion 88 to be withdrawn therefrom thereby permitting section 22 to swing free from section 20. From the foregoing then, it is clear that the spring biased pivotal mountings associated with wheel members 82 and female structure 86 provide yieldable articulations which novelly cooperate to allow reliable operation of the gate apparatus.

In the absence of engagement by a vehicle 18 with the engageable members 39, it can be appreciated that each of the gate sections 20 and 22 remain in a latched position by virtue of the corresponding pairs of latching members 60 and 62 which engage stop elements 76 on respective opposite sides of the latter whereby to prevent the corresponding gate section 20 or 22 from swinging movement. Moreover, it is important to note that in the event that one of the engageable structures 39 is inadvertently engaged and pivoted by livestock or the like, the associated latching means of that gate section will be unlatched, however, the unlatched gate section will not be allowed to swing open by virtue of the locking assembly 84 which normally prevents swinging motion of the unlatched gate section unless the other of the gate sections 20 or 22 is likewise unlatched, it being understood that the spring 101 is chosen such that the tension force thereof may be overcome by the substantial thrust of an oncoming vehicle but may not be overcome by livestock merely "leaning" on the gate sections.

In view of the above, it is amply clear that the engageable structures 39 in combination with their associated latching means cooperate with the locking assembly 84 in a manner to prevent inadvertent opening of the gate sections 20 and 22 in the absence of simultaneous engagement of both of the engageable structures 39, whereby to effect simultaneous unlatching of both gate sections 20 and 22. By virtue of the significant spacing between engageable members 39 respectively associated with the gate sections 20 and 22, it is apparent that livestock such as a cow is not likely to simultaneously engage both of the engageable members 39, thus, the gate apparatus provides an especially reliable combination for preventing the accidental opening of the gated zone.

From the foregoing, it is clear that the invention provides especially effective means for automatically unlatching and opening and subsequently closing and latching a gated zone, but which is not subject to inadvertent operation by livestock or the like. Thus, it will be observed that my improved apparatus not only provides for the reliable accomplishment of the objects of the invention, but does so in a particularly simple and reliable manner. It is recognized, of course, that those skilled in the art may make various modifications or additions to the preferred embodiment chosen to illustrate the invention without departing from the gist and essence of my contribution to the the art. Accordingly, it is to be understood that the protection sought and to be afforded hereby should be deemed to extend to the subject matter claimed and all equivalents thereof fairly within the scope of the invention.

I claim:

1. In drive-through gate apparatus for automatically gating a zone extending across a passageway between a pair of stretches of the latter, which apparatus is automatically unlatchable and openable and is automatically closeable and relatchable in response to a vehicle traversing said zone in either a first direction from one to the other of said stretches of said passageway or in an opposite direction from said other to said one of said stretches of said passageway:

a pair of spaced support means disposed adjacent the opposite extremities of said zone;

a pair of separate gate sections each adapted to be respectively mounted upon a corresponding one of said support means for swinging movement with respect to the latter, each of said sections being movable between a normal closed position thereof in which said section extends from adjacent the support means upon which it is mounted generally along a corresponding portion of said zone toward the adjacent extremity of the other gate section, and either of a pair of oppositely opened positions thereof in which said section extends from adjacent the support means upon which it is mounted at an angle from said zone and generally in either said first direction from said one to the other of said stretches of said passageway or said opposite direction from said other to said one of said stretches of said passageway;

means for normally yieldably urging said gate sections toward said closed positions thereof;

means for automatically latching each of said gate sections respectively in said closed position thereof, each of said latching means being actuatable into a released condition thereof to permit the corresponding gate section to move to either of said opened positions thereof, each of said latching means including a stationary portion having holding means disposed in said zone of said passageway, and a shiftable portion having latchable structure mounted on the corresponding gate section, each of said latchable structures being normally engaged with and restrained by said holding means to latch the corresponding gate section in said closed position thereof, but being shiftable out of a position for restraining engagement thereof with said holding means for unlatching said corresponding gate section to allow the latter to move to an opened position thereof; and engageable means shiftably mounted on each of said gate sections and disposed to be engaged by a vehicle entering said zone, each of said engageable means including means shiftable relative to the corresponding of said gate sections under the influence of engagement of said engageable means by said vehicle and operably coupled with the corresponding of said latching means for actuating the latter into said released condition thereof when said shiftable means are shifted, whereby said gate sections may be moved to either of said opened positions thereof by said vehicle traversing said zone in the corresponding direction, said latchable structure of each of said latching means including a pair of spaced, selectively shiftable latch members, said stationary portion of each of said latching means being mounted on the ground beneath the corresponding section, and said holding means thereof including a pair of stop elements engageable with corresponding ones of said pair of said latch members on respective opposite sides of the latter when said gate section is in said closed position thereof, one of said latch members of each pair thereof being shifted by a corresponding shiftable means away from its corresponding stop element and into clearing relationship to the latter when said vehicle traverses said zone in said first direction to permit said gate section to move to one of its said opened positions, the other of said latch members of each pair thereof being shifted by a corresponding shiftable means away from its corresponding stop element and into clearing relationship to the latter when said vehicle traverses said zone in said opposite direction to permit said gate section to move to the other of its said opened positions.

2. The invention of claim 1, wherein:

said engageable means are swingably mounted on the corresponding gate sections, and each latch member has one extremity thereof pivotally connected to the corresponding gate section with the opposite extremity of each latch member being swingable into and out of engagement with the corresponding holding means, each of said shiftable means including structure provided with a camming surface shiftable in response to pivotal movement of said engageable means for contacting portions of the corresponding latch member and urging the latter to swing away from the corresponding holding means out of engagement with the latter.

3. The invention of claim 1, wherein each of said gate sections is provided with one of said engageable means, said engageable means respectively associated with said gate sections are spaced apart across said zone when said gate sections are in said closed positions thereof, and each of said engageable means includes:

structure having a pair of spaced engageable portions including respective oppositely facing engageable surface areas on opposite sides of said gate section respectively adjacent said passageway stretches, said engageable structure being pivotally mounted on said gate section and pivotable in a first direction in response to engagement of one of said engageable portions by said vehicle traversing said zone in said direction from one to the other of said stretches and being pivotable in a second direction in response to engagement of the other of said engageable portions by said vehicle traversing said zone in said opposite direction, said shiftable means being connected with each of said engageable portions and including a pair of cam members respectively associated with said latch members and shiftable upon pivoting of said engageable structure for slidably engaging portions of selective ones of said latch members and urging the latter to shift away from its associated stop element.

4. The invention of claim 3, wherein:

said engageable structure comprises a generally U-shaped member having a bight and a pair of legs, and being mounted adjacent said bight thereof for pivotal movement about an essentially upright axis, said shiftable means further including a pair of limit elements respectively associated with said cam members and disposed adjacent the latter for limiting the sliding movement of said cam members with respect to said portions of said latch members and for transfering force imposed by said vehicle on said engageable means to gate section whereby to effect swinging movement of the latter, each of said latch members of said pair thereof having one end thereof pivotally connected to said gate section to provide swinging movement of the opposite end thereof toward and away from its associated stop element, each of said stop elements including upright surface areas extending in the direction of said zone and engageable with said opposite end of an associated latch member for retaining the latter in a latched condition said latching portion further including a pair of upright wall portions respectively associated with said stop elements and adjacent the latter, and respectively extending away from said stop elements at an angle to said zone, said wall portions of said latching portion functioning to slidably engage a respectively associated latch member and shift the latter to said latched condition thereof in engagement with a corresponding stop element when the associated gate section is moved from one of said open positions thereof to said closed position thereof.

5. The invention of claim 1, wherein each of said engageable means includes a pair of spaced apart engageable members operably connected with said shiftable means and each responsive to engagement by said vehicle to cause said shiftable means to shift, there being further provided:

releaseable holding means operably connected between said adjacent extremities of said gate sections for maintaining said gate sections in said closed positions thereof when only one of said engageable members is engaged, said releasable holding means being operable in response to the simultaneous engagement of both of said engageable members for releasing said gate sections to allow the latter to move from said closed to said open positions thereof.

6. The invention of claim 5, wherein said releasable holding means comprises:

a male member mounted on one of said gate sections for reciprocable movement between a retracted and extended position and toward and away from the other of said gate sections when the latter are in said closed positions thereof, yieldable biasing means for normally urging said male member toward its said extended position toward said other gate section, female structure mounted on said other gate section and including recessed portions for complementally receiving said male member in holding relationship therewithin when the latter is in said extended position thereof, said male member withdrawing from said recessed portions upon simultaneous swinging movement of said gate sections from said closed to said open positions thereof, and camming structure mounted on said other gate section adjacent said female structure for slidably engaging portions of said male member and shifting the latter to said retracted position thereof when said gate sections are moved from said closed to said open positions thereof whereby to effect insertion of said male member into said recessed portions.

7. In drive-through gate apparatus for gating a zone between stretches of a passageway on opposite sides of said zone:

support means disposed adjacent an extremity of said zone;

gate means;

means for mounting said gate means for swinging movement between a normal, closed position thereof extending along said zone and either of a pair of opened conditions thereof respectively displaced on opposite sides of said zone;

means for yieldably urging said gate means toward said closed position thereof;

stop means fixedly disposed relative to said zone;

a pair of latch members;

means for shiftably mounting one of said latch members on said gate means for movement between a latching position thereof in which, when said gate means is in closed position thereof, said one latch member is disposed for engaging the side of said stop means facing one side of said zone to block said gate means against movement toward said opened condition thereof displaced from the other side of said zone and a releasing position thereof in which said one latch member clears said stop means to permit movement of said gate means toward said last mentioned opened condition thereof;

means for shiftably mounting the other of said latch members on said gate means for movement between a latching position thereof in which, when said gate means is in said closed position thereof, said other latch member is disposed for engaging the side of said stop means facing the other side of said zone to block said gate means against movement toward said opened condition thereof displaced from said one side of said zone and a releasing position thereof in which said other latch member clears said stop means to permit movement of said gate means toward said last mentioned opened condition thereof;

means shiftably mounted on said gate means and disposed to be engaged and shifted by a vehicle approaching from either side of said zone; and means operably coupling said engageable means with each of said latch members for moving said one latch member from said latching position thereof to said releasing position thereof when said engageable means is engaged and shifted by a vehicle approaching from said one side of said zone and for moving said other latch member from said latching position thereof to said releasing position thereof when said engageable means is engaged and shifted by a vehicle approaching from said other side of said zone, whereby, said gate means may be automatically unlatched by a vehicle engaging said engageable means while approaching said gate means from either side of said zone.

8. The invention of claim 7, wherein said stop means and each of said latch members are provided with cooperating surfaces interengageable in camming relationship for temporarily shifting a previously released latch member from its latching position to its releasing position as said gate means is returned from an opened condition to said closed position thereof under the influence of said urging means, whereby to permit said gate means to fully return to its closed position after opening thereof and to permit the previously released latch member to then automatically relatch said gate means in its closed position.

* * * * *